US005132146A

United States Patent [19]

Maruyama et al.

[11] Patent Number: 5,132,146

[45] Date of Patent: Jul. 21, 1992

[54] METHOD OF AQUEOUS INK PRINTING ON AN INK ABSORBING LAYER BEING COATED ON A SUBSTRATE

[75] Inventors: Hitoshi Maruyama, Kurashiki; Isao Ono, Okayama; Sadahiko Shiraga; Junnosuke Yamauchi, both of Kurashiki, all of Japan

[73] Assignee: Kuraray Co., Ltd., Kurashiki, Japan

[21] Appl. No.: 608,615

[22] Filed: Nov. 5, 1990

Related U.S. Application Data

[63] Continuation of Ser. No. 397,373, Aug. 24, 1989, abandoned, which is a continuation of Ser. No. 282,966, Dec. 6, 1988, abandoned, which is a continuation of Ser. No. 141,502, Jan. 7, 1988, abandoned.

[30] Foreign Application Priority Data

Jan. 16, 1987 [JP] Japan ..... 62-8818

[51] Int. Cl.[5] ..... B05D 5/00

[52] U.S. Cl. ..... 427/261; 427/164; 427/288; 346/1.1

[58] Field of Search ..... 346/1.1, 135.1; 427/261, 256, 288, 164; 428/195, 211, 537.5, 483, 480, 530, 514

[56] References Cited

U.S. PATENT DOCUMENTS

| | | | |
|---|---|---|---|
| 4,474,847 | 10/1984 | Schröder et al. | 428/323 |
| 4,708,947 | 11/1987 | Maruyama et al. | 503/226 |

FOREIGN PATENT DOCUMENTS

| | | | |
|---|---|---|---|
| 187673 | 7/1986 | European Pat. Off. | 428/195 |
| 162382 | 7/1986 | Japan | 428/520 |
| 162383 | 7/1986 | Japan | 428/520 |
| 211356 | 9/1986 | Japan | 503/226 |
| 211357 | 9/1986 | Japan | 503/226 |

*Primary Examiner*—Evan Lawrence

*Attorney, Agent, or Firm*—Oblon, Spivak, McClelland, Maier & Neustadt

[57] ABSTRACT

The present invention relates to a method of aqueous printing on a recording medium for ink, the recording medium having an excellent ink absorbing property and a markedly excellent waterproof property, the method characterized in that the recording medium comprises a substrate containing a composition which comprises polyvinyl alcohol, chitosan and an aldehyde compound.

4 Claims, No Drawings

METHOD OF AQUEOUS INK PRINTING ON AN INK ABSORBING LAYER BEING COATED ON A SUBSTRATE

This application is a continuation of application Ser. No. 07.397,373 filed on Aug. 24, 1989, now abandoned which is a continuation of Ser. No. 07/282,966, filed Dec. 6, 1988, abandoned, which is a continuation of Ser. No. 07/141,502, filed Jan. 7, 1988, now abandoned.

BACKGROUND OF THE INVENTION

1. Field of the Invention

The present invention relates to a method of aqueous ink printing on a recording medium for ink and more particularly, to aqueous ink printing on a recording medium for ink having an excellent absorption property for aqueous ink for use in ink jet printing or aqueous ink for use in pen-type printing and having a markedly excellent waterproof property.

2. Description of the Prior Art

In recent years, application of the ink jet printing system to facsimile, various printers, etc. has been promoted because noise is minimized, color printing is easy, high speed recording can be made, etc. in the system. Further in pen-type printing, the system of using aqueous ink has become popular because the tip of a pen becomes dry only with difficulty, the movement of the tip of a pen is smooth, etc. Ordinary paper has been heretofore employed as materials to be recorded used for these recording systems. However as efficiencies of recording machines such as high speed recording, multicolor printing, etc. are improved, properties of higher degree have been required also for recording media for ink. That is, a first requirement is that a rate of absorbing ink be large, a second requirement is to cause no blotting of ink, for example, cause no undersired broadening of a diameter of ink dot in the case of using as recording media for ink jet printing and a third requirement is that recording media for ink have an excellent waterproof property; etc.

In order to satisfy these requirements, various devices have been made, for example, using paper or water soluble resin as materials for absorbing aqueous ink; or the like. However, when a rate of absorbing ink is increased, serious blotting occurs, for example, in the case of using recording media for ink jet printing, an ink dot diameter becomes undesirably broad or waterproof property becomes extremely poor, etc., resulting in being far below requirements on a practical level under the actual situation.

SUMMARY OF THE INVENTION

An object of the present invention is to provide a method for aqueou ink printing on a recording medium for ink, which medium satisfies the various requirements described above and, in particular, is excellent in ink absorbing properties and waterproof properties.

Another object of the present invention is to provide a method for aqueous in printing on a recording medium for ink having excellent transparency which can be used for observation through projection of recorded images with optical equipments such as slide projectors, OHP, etc. onto a screen, etc. or for observation of transmitted light such as color display, etc.

DETAILED DESCRIPTION OF THE INVENTION

As a result of extensive investigations to solve the problems described above and achieve the objects described above, the present inventors have found that recording media for ink comprising a substrate containing a composition which comprises polyvinyl alcohol (hereafter polyvinyl alcohol is simply referred to as PVA), chitosan and aldehyde compounds, in particular, recording media for ink comprising a substrate having provided on the surface thereof an ink absorbing layer containing a composition which comprises PVA, chitosan and aldehyde compounds, are excellent in an ink absorbing property and markedly excellent in waterproof property and, have come to accomplish the present invention.

Hereafter the present invention will be described in detail.

As PVA which can be used in the present invention, any PVA are usable as far as they are water soluble. In addition to ordinary PVA, silane-modified PVA, anion-modified PVA such as carboxyl group-modified PVA, sulfonic acid group-modified PVA, phosphoric acid group-modified PVA, cation-modified PVA, or modified PVA obtained by copolymerizing ethylene, vinyl ethers having a long chain alkyl group, vinyl esters, (meth) acrylamides, $\alpha$-olefin, etc. can also be used.

A polymerization degree of these PVA is not particularly limited but is generally chosen from a range of 100 to 3000. A degree of hydrolysis is not particularly limited as far as PVA is water soluble, but generally chosen from a range of 70 to 100 mol %.

As chitosan used in the present invention, chitosan containing 40 mol % or more, preferably 80 mol % or more amino groups, or a part or whole of which amino groups has been converted with an acid into ammonium groups can be used.

A molecular weight of chitosan is not particularly limited and can be used in various molecular weights. However, when chitosan having such a molecular weight that a viscosity (by BL type viscometer; hereafter the same) of a 1 wt % aqueous solution at 20° C. exceeds 70 centipoise is used, the viscosity of a coating solution comprising the PVA, chitosan and aldehyde compound used in the present invention becomes high and in case that a concentration of the coating solution is high, waterproof effect is not sufficiently exhibited, probably due to poor compatibility with PVA, Therefore, chitosan having the viscosity of a 1 wt % aqueous solution at 20° C. of 1 to 70 cp, more preferably 1 to 30 cp, is preferable.

Chitosan used in the present invention can be dissolved in water or an aqueous solution containing an acid. As the acid, acetic acid, formic acid, glycolic acid, lactic acid, citric acid, benzoic acid, sulfamic acid, hydrochloric acid, phosphoric acid, fumaric acid, maleic acid, etc. are generally used.

As the aldehyde compound used in the present invention, any compound is usable as far as it is water soluble and generates a substrate having at least one aldehyde group in an aqueous solution. Specific examples of the aldehyde compound include a monoaldehyde such as formalin, acetaldehyde, propionaldehyde, butylaldehyde, etc.; a polyvalent aldehyde such as glyoxal, glutaraldehyde, dialdehyde starch, etc.; a condensation product between formaldehyde and ammonia such as hexamethylenetetramine, etc.; a methylolamide such as dimethylol urea, N-methylolacrylamide, etc.; urea-formaldehy resin, melamine-formaldehyde resin, etc.

Of the aldehyde compounds described above, glyoxal or hexamethylenetetramine is preferably use because of easy handling (odorless property, viscosity stability, etc.) of a coating solution comprising PVA, chitosan and aldehyde compound used in the present invention and the effect of waterproof property.

A ratio of PVA, chitosan and aldehyde compound to be formulated is advantageously 1 to 50 parts by weight, preferably, 5 to 30 parts by weight, of chitosan and 0.1 to 10 parts by weight, preferably 0.5 to 5 parts by weight, of the aldehyde compound, based on 100 parts by weight of PVA. With less than 1 part by weight, chitosan has no effect and with above 50 parts by weight, a viscosity of the aforesaid coating solution becomes high and such is not preferred. Further with less than 0.1 part by weight, the aldehyde compound has no effect and with above 10 parts by weight, a viscosity stability of the aforesaid coating solution becomes poor.

The composition comprising PVA, chitosan and aldehyde compound used in the present invention can be employed as it is but may also be used in combination with other water soluble or water dispersible resins.

As the other water soluble or water dispersible resins which can be used in combination, mention may be made of albumin, gelatin, casein, starch, gum arabic; cellulose derivatives such as methyl cellulose, hydroxyethyl cellulose, etc.; nonionic water soluble resins such as polyamide resins, melamine resins, poly(meth)acrylamide, polyvinylpyrrolidone, etc.; anionic water soluble resins such as CMC, sodium poly(meth)acrylate, water soluble polyesters, etc.; cationic water soluble resins such as polyethyleneimine, polyvinylamine, polyallylamine, polyallylamine-sulfone copolymers or ammonium salts thereof, cationated starch, cationated poly(meth)acrylamide, cationated polyamide resin, etc.; water dispersible resins such as SBR latex, NBR latex, vinyl acetate emulsions, ethylene/vinyl acetate copolymer emulsions, (meth)acrylic acid ester emulsions, vinyl chloride emulsions, etc.

In case that these water soluble or water dispersible resins are used in combination with the composition of the present invention, a ratio to be used in combination is less than 100 parts by weight, preferably less than 50 parts by weight, based on 100 parts by weight of PVA used in the present invention.

Further the composition comprising PVA, chitosan and aldehyde compound used in the present invention can also be used in combination with fillers such as silica, clay, talc, diatomaceous earth, zeolite, calcium carbonate, alumina, zinc oxide, satin white, etc. In this case, a ratio to be used in combination varies according to the case in which recording media having excellent transparency are required or other recording media are required; in general, a weight ratio of [PVA of the present invention/filler] is chosen from a range of 1/100 to 100/1, preferably 5/100 to 100/5.

The composition comprising PVA, chitosan and aldehyde compound used in the present invention can be per se used as an ink absorbing layer because the composition itself has an excellent ink absorbing property. However, the composition may also be used as a waterproofing layer by forming a layer comprising the composition onto an ink absorbing layer comprising other ink absorbing materials.

As the substrate used in the present invention, any of known transparent and opaque substrates can be used. As the transparent substrate, mention may be made of a film or sheet of, for example, polyester, polystyrene, polyvinyl chloride, polymethyl methacrylate, cellulose acetate, polycarbonate, polyimide, cellophane, celluloid, etc. or paper having high transparency, etc. As the opaque substrate, mention may be made of, for example, ordinary paper, pigmentcoated paper, cloth, wood, a metal plate, synthetic paper, a film or sheet of synthetic resin treated to be opaque, etc.

In the case of recording media for ink having excellent transparency which is an object of the present invention, a transparent substrate is used.

As a method for incorporating the composition comprising the PVA, chitosan and aldehyde compound in the substrate, there can be used a method which comprises immersing an aqueous solution of the composition described above, or an aqueous solution or aqueous dispersion of a mixture of the composition with other water soluble or water dispersible resins or fillers in the substrate; or forming a coated layer(s) on the upper surface, or lower surface or both surfaces of the substrate; by means of conventional coating method such as a size press, an air knife coater, a roll coater, a bar coater, a blade coater, etc.

Furthermore, an adhesive resin is coated on the substrate and the aforesaid composition can be coated thereon. As the adhesive resin used in this case, mention may be made of, for example, a composition of polyurethane and an isocyanate, a rubber adhesive, an emulsion adhesive, etc.

In case that the substrate is paper, the aqueous solution or aqueous dispersion described above can also be incorporated upon paper making.

A content of the composition comprising PVA, chitosan and aldehyde compound described above used in the recording media for ink of the present invention is not particularly limited but generally 0.1 to 200 g/m$^2$, preferably 1 to 100 g/m$^2$.

The recording media for ink of the present invention are mainly useful as recording media for ink jet printing by spraying liquid ink, especially aqueous ink but are not limited thereto and likewise useful as recording media for pen-type printing or recording pens by directly contacting liquid ink, especially aqueous ink with recording media.

The aqueous ink used for printing on the aforementioned media of the present invention is aqueous composition comprising principally a water soluble dye, a wetting agent and a solvent which contains not less than 20 weight % water, more preferably not less than 50 weight % water and less than 80 weight % water soluble organic solvent, more preferable less than 50 weight % water soluble organic solvent. As the organic solvent, following compounds are usable, for example, alcohols with 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amide compounds such as dimethylformamide and dimethylacetamide; ketones such as such as acetone and diacetone alcohol; ethers such as tetrahydrofuran and dioxane; polyalkylene glycols such as polyethylene glycol and polypropylene glycol; alkylene glycols or polyols with 2 to 6 carbon atoms such as ethylene glycol, propylene glycol, 1,2,6-hexanetriol, hexylene glycol, diethylene glycol and glycerin, and ethers of polyols such as ethylene glycol methyl ether, diethylene glycol methyl ether and triethylene glycol monomethyl ether; pyrrolidones such as 2-methylpyrrolidone.

Reasons why the recording media for ink of the present invention are excellent in ink absorbing property and extremely excellent in waterproof property are not exactly clarified but are assumed as follows.

The composition comprising PVA, chitosan and aldehyde compound used in the present invention is water soluble prior to forming its coating and hydrophilic even after forming the coating; however, the obtained coating has a remarkable high waterproof property so that it is assumed that the recording media for ink having markedly excellent ink absorbing property and waterproof property could be formed.

The present invention will be described in more detail with reference to the examples below but is not deemed to be limited thereto. In the examples, "%" and "part" are all based on weight, unless otherwise indicated.

EXAMPLES (1) Method of ink jet printing

Using a recording device equipped with an on-demand type ink jet printing head having a discharge orifice with a diameter of 60 μm, color ink jet printing was made using 4 color inks described below and evaluation was made on recording properties.

| | |
|---|---|
| (1) Yellow ink (composition) | |
| C.I. Acid yellow 2.3 | 2 parts |
| Diethylene glycol | 30 parts |
| Water | 70 parts |
| (2) Magenta ink (composition) | |
| C.I. Acid red 32 | 2 parts |
| Diethylene glycol | 30 parts |
| Water | 70 parts |
| (3) Cyan ink (composition) | |
| C.I. Direct blue 86 | 2 parts |
| Diethylene glycol | 30 parts |
| Water | 70 parts |
| (4) Black ink (composition) | |
| C.I. Direct black 19 | 2 parts |
| Diethylene glycol | 30 parts |
| Water | 70 parts |

(2) Rate of absorbing ink

After recording with ink, printed matters on a recording sheet was rubbed with the finger every definite time and a time period until it was determined that no further change in the printed matters was caused thereby. The shorter the time period, the larger the rate of absorbing ink.

(3) Blotting degree

A diameter of a dot of the printed matter was measured by a stereoscopic microscope, thereby to determine a magnification of the original diameter of the ink droplet. The lower the magnification, the less the blotting degree.

(4) Degree of transparency

Transmittance (%) of visible rays at non-printed areas on the recording media for ink was measured with a spectrophotometer using visible rays having a wavelength of 500 nm. The thus measured transmittance was made a degree of transparency. The larger the transmittance, the higher the degree of transparency.

(5) Waterproof property

Water was attached to the printed matters on the sheet after recording with ink. The waterproof property was determined by whether or not the printed matters were dissolved or got blotted when rubbed with the finger.

5: No change
4: Blotting occurred a little but no dissolution occurred.
3: Blotting and swelling occurred though no dissolution occurred.
2: Blotting occurred and dissolution occurred a little.
1: Both blotting and dissolution occurred.

EXAMPLE 1

In an acetic acid-acidic aqueous solution were dissolved 100 parts of PVA (Kuraray Poval PVA-405) having a polymerization degree of 550 and a degree of hydrolysis of 80 mol % and 15 parts of chitosan having a viscosity of 13 cp in 1% aqueous solution at 20° C. (viscosity measured with BL type viscometer) and having an amino group content of 89 mol % to prepare 15% aqueous solution.

A coating solution was prepared by adding 40% glyoxal to this aqueous solution in a ratio of 2% calculated as the solid content based on PVA.

The coating solution was coated onto a polyester sheet having a thickness of 50 μm and a transparency degree of 95% in a dry solid content of 20 g/m$^2$ and dried to give a recording medium for ink. A rate of absorbing ink, a blotting degree, a transparency degree and a waterproof property are shown in Table 1, when ink jet printing was made onto this sheet.

EXAMPLES 2 TO 8

Procedures were performed in a manner similar to Example 1 except that PVA or chitosan content was changed to PVA and chitosan content shown in Table 1. The results are also shown in Table 1.

COMPARATIVE EXAMPLES 1 TO 4

Procedures were preformed in a manner similar to Example 1 except that the following resin was used in place of the composition used in Example 1. The results are also shown in Table 1.

Resin used in Comparative Example 1:
15% aqueous solution containing 100 parts of PVA-405 and 2 parts of glyoxal Resin used in Comparative Example 2:
10% aqueous solution containing chitosan alone used in Example 1

Resin used in Comparative Example 3:
10% aqueous solution containing polyvinylpyrrolidone alone Resin used in Comparative Example 4:
15% aqueous solution containing cation-modified PVA alone containing 2 mol % of cation group and having a polymerization degree of 1750 and a degree of hydrolysis of 88 mol %

TABLE 1

| | (Note 1) PVA | Chitosan (%/PVA) | Ink Absorbing Rate (sec) | Blotting Degree (times) | Transparency Degree (%) | Waterproof Property |
|---|---|---|---|---|---|---|
| Example | | | | | | |

TABLE 1-continued

| | (Note 1) PVA | Chitosan (%/PVA) | Ink Absorbing Rate (sec) | Blotting Degree (times) | Transparency Degree (%) | Waterproof Property |
|---|---|---|---|---|---|---|
| 1 | PVA-405 | 15 | 30 | 2.1 | 95 | 5 |
| 2 | PVA-405 | 1 | 45 | 2.0 | 95 | 3 |
| 3 | PVA-405 | 30 | 35 | 2.0 | 95 | 4 |
| 4 | PVA-405 | 45 | 40 | 2.2 | 95 | 3 |
| 5 | PVA-420 | 15 | 30 | 2.1 | 95 | 5 |
| 6 | Carboxyl-modified PVA | 15 | 30 | 2.1 | 95 | 5 |
| 7 | Sulfonic acid-modified PVA | 15 | 40 | 2.1 | 95 | 5 |
| 8 | Cation-modified | 15 | 25 | 2.1 | 95 | 5 |
| Comparative Example | | | | | | |
| 1 | PVA-405 | 0 | 80 | 2.7 | 95 | 1 |
| 2 | — | 100 | 150 | 3.5 | 95 | 1 |
| 3 | — | 0 | 80 | 4.0 | 95 | 1 |
| 4 | Cation-modified PVA | 0 | 50 | 2.3 | 95 | 1 |

(Note 1)
PVA-420: PVA having a polymerization degree of 1750 and a degree of hydrolysis of 80 mol %
Carboxyl-modified PVA: PVA containing 1 mol % of carboxyl group unit and having a polymerization degree of 1750 and a degree of hydrolysis of 88 mol %
Sulfonic acid-modified PVA: PVA containing 1 mol % of sulfonic acid group unit and having a polymerization degree of 1800 and a degree of hydrolysis of 88 mol %
Cation-modified PVA: PVA containing 2 mol % of cationic group unit and having a polymerization of 1750 and a degree of hydrolysis of 88 mol %

EXAMPLES 9 TO 12

In a lactic acid-acidic aqueous solution were dissolved 100 parts of modified PVA containing 2 mol % of a cation group unit and having a polymerization degree of 1750 and a degree of hydrolysis of 80 mol % and 10 parts of chitosan having a viscosity as shown in Table 2 in 1% aqueous solution at 20° C. (viscosity measured with BL type viscometer) and having an amino group content of 85 mol % to prepare 15% aqueous solution. A coating solution was prepared by adding 40% glyoxal to this aqueous solution in a ratio of 1% calculated as the solid content based on PVA.

The coating solution was coated onto a transparent polyester sheet having a thickness of 75 μm in a dry solid sontent of 5 g/m$^2$ and dried to give a recording medium for ink. A rate of absorbing ink and a waterproof property are shown in Table 2, when ink jet printing was made onto this sheet.

EXAMPLES 13 TO 15

Procedures were performed in a manner similar to Example 9 except that the amount of glyoxal added was changed to the content shown in Table 2. The results are also shown in Table 2.

EXAMPLES 16 TO 20

Procedures were performed in a manner similar to Example 9 except that aldehyde compounds shown in Table 2 were used in amounts shown in Table 2 in place of glyoxal (1%/PVA). The results are also shown in Table 2.

TABLE 2

| Example | Viscosity of Chitosan (cp) | Aldehyde Compound | Amount Added (%/PVA) | Ink Absorbing Rate (sec) | Waterproof Property |
|---|---|---|---|---|---|
| 9 | 5 | glyoxal | 1 | 25 | 5 |
| 10 | 1 | glyoxal | 1 | 25 | 4 |
| 11 | 25 | glyoxal | 1 | 30 | 4 |
| 12 | 65 | glyoxal | 1 | 40 | 3 |
| 13 | 5 | glyoxal | 0.2 | 25 | 4 |
| 14 | 5 | glyoxal | 5 | 35 | 5 |
| 15 | 5 | glyoxal | 10 | 40 | 5 |
| 16 | 5 | hexamethylenetetramine | 5 | 30 | 5 |
| 17 | 5 | formaldehyde | 1 | 30 | 4 |
| 18 | 5 | methylolamide | 1 | 30 | 3 |
| 19 | 5 | urea-formaldehyde resin | 5 | 30 | 4 |
| 20 | 5 | melamine-formaldehyde resin | 5 | 30 | 4 |

EXAMPLE 21

The composition used in Example 8 was coated onto the polyvinylpyrrolidone layer of the recording medium for ink obtained in Comparative Example 3 in a dry solid content of 5 g/m$^2$ and dried to give a recording medium for ink. The results are shown in Table 3.

EXAMPLE 22

The composition used in Example 1 was coated onto the cation-modified PVA layer of the recording medium for ink obtained in Comparative Example 4 in a dry solid content of 3 g/m$^2$ and dried to give a recording medium for ink. The results are shown in Table 3.

TABLE 3

| Example | Ink Absorbing Rate (sec) | Blotting Degree (times) | Transparency Degree (%) | Waterproof Property |
|---|---|---|---|---|
| 21 | 25 | 2.1 | 95 | 5 |
| 22 | 30 | 2.1 | 95 | 5 |

EXAMPLE 23

Procedures were performed in a manner similar to Example 8 except that art paper was used as a substrate. An ink absorbing rate, blotting degree and waterproof property were 25 seconds, 2.1 times and 5, respectively.

EXAMPLE 24

Wood free paper was used as a substrate. A coating solution having a composition described below, which was obtained using the composition used in Example 1, was coated onto the substrate in a dry solid content of 20 g/m$^2$ by means of a bar coater and dried to give a recording medium for ink. An ink absorbing rate, blotting degree and waterproof property of this sheet are shown in Table 4.

| | |
|---|---|
| Non-colloidal silica powders | 100 parts |
| Composition used in Example 1 | 25 parts |
| Water | 500 parts |

COMPARATIVE EXAMPLE 5

Procedures were performed in a manner similar to Example 24 except that PVA used in Comparative Example 1 was used in place of the composition used in Example 24. The results are also shown in Table 4.

TABLE 4

| Example | Ink Absorbing Rate (sec) | Blotting Degree (times) | Waterproof Property |
|---|---|---|---|
| 24 | <1 | 1.9 | 5 |
| Comparative Example 5 | <1 | 2.8 | 1 |

EXAMPLE 25

Wood free paper was used as a substrate. A coating solution which was obtained using the composition used in Example 2, was coated onto the substrate in a dry solid content of 5 g/m$^2$ and dried to give a recording medium for ink. Efficiencies of this sheet are shown in Table 5.

COMPARATIVE EXAMPLE 6

Procedures were performed in a manner similar to Example 25 except that polyvinylpyrrolidone was used in place of the composition used in Example 25. The results are also shown in Table 5.

TABLE 5

| Example | Ink Absorbing Rate (sec) | Blotting Degree (times) | Waterproof Property |
|---|---|---|---|
| 25 | <1 | 2.2 | 4 |
| Comparative | <1 | 4.5 | 1 |

TABLE 5-continued

| Example | Ink Absorbing Rate (sec) | Blotting Degree (times) | Waterproof Property |
|---|---|---|---|
| Example 6 | | | |

EXAMPLE 26

Using the recording medium obtained in Example 9 and pens having respective colors out of 4 colored inks used in the ink jet printing, crossing linear lines and painted circles overlapping with each other were drawn by a pen-type printer.

Immediately after the recording with the pens, recorded portions were rubbed with the finger but no change was noted on the printed matters. Also in the crossed portions on crossing linear lines and the overlapping painted circles, recording was able to make, without causing blotting of the respective inks and without injuring the coated layer.

Waterproof property after the recording was 5.

COMPARATIVE EXAMPLES 7 AND 8

Procedures were performed in a manner similar to Example 26 except for using the following recording media.

Recording medium used in Comparative Example 7:

Recording medium obtained in Comparative Example 1.

Serious blotting of ink was noted in crossed portions on crossing linear lines and overlapping circle areas and waterproof property was 1.

Recording medium used in Comparative Example 8:

Recording medium obtained in Comparative Example 3.

Breakage due to scratching with the pen occurred in crossed portions on crossing linear lines and overlapping circle areas and at the same time, serious blotting of ink was noted. Waterproof property was 1.

While the invention has been described in detail and with reference to specific embodiments thereof, it will be apparent to one skilled in the art that various changes and modifications can be made therein without departing from the spirit and scope thereof.

We claim:

1. A method of aqueous ink printing on an ink absorbing layer coated on a substrate, comprising printing an aqueous ink onto the ink absorbing layer, wherein said ink absorbing layer is a composition comprising polyvinyl alcohol, chitosan and an aldehyde compound, and said ink exhibits a blotting of no more than 2.1 magnification and an ink absorbing rate of no more than 45 seconds.

2. A method of aqueous ink printing on an ink absorbing layer coated on a substrate as claimed in claim 1 wherein said ink printing is ink jet printing.

3. A method of aqueous ink printing on an ink absorbing layer coated on a substrate as claimed in claim 1 wherein said ink printing is ink pen-type printing.

4. A method of aqueous ink printing on an ink absorbing layer coated on a substrate as claimed in claim 1 wherein a ratio of said polyvinyl alcohol, chitosan and an aldehyde compound to be formulated is 1 to 50 parts by weight of chitosan and 0.1 to 10 parts by weight of the aldehyde compound, based on 100 parts by weight of the polyvinyl alcohol.

* * * * *